US010463106B2

(12) United States Patent
Peyton et al.

(10) Patent No.: US 10,463,106 B2
(45) Date of Patent: Nov. 5, 2019

(54) SOLE ASSEMBLY WITH TEXTILE SHELL AND METHOD OF MANUFACTURING SAME

(71) Applicant: NIKE, Inc., Beaverton, OR (US)

(72) Inventors: Lee D. Peyton, Tigard, OR (US); Margarita Cortez, Portland, OR (US); Benjamin J. Monfils, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 705 days.

(21) Appl. No.: 14/179,956

(22) Filed: Feb. 13, 2014

(65) Prior Publication Data

US 2015/0223564 A1 Aug. 13, 2015

(51) Int. Cl.
*A43B 13/20* (2006.01)
*A43B 13/18* (2006.01)
(Continued)

(52) U.S. Cl.
CPC ..... *A43B 13/20* (2013.01); *A43B 13/026* (2013.01); *A43B 13/04* (2013.01); *A43B 13/122* (2013.01);
(Continued)

(58) Field of Classification Search
CPC ..... A43B 13/20; A43B 13/18; A43B 13/12; A43B 13/026; A43B 13/122; A43B 13/14; A43B 13/141; A43B 13/146
(Continued)

(56) References Cited

U.S. PATENT DOCUMENTS 4,241,524 A * 12/1980 Sink ..... A43B 5/06 36/102
5,063,692 A 11/1991 Suginaka
(Continued)

FOREIGN PATENT DOCUMENTS

EP 2292113 A2 3/2011
EP 2609824 A1 7/2013
(Continued)

OTHER PUBLICATIONS http://www.mephistoshoesusa.com/store/content/67/Shoe-Technology/ , "16 Reasons to Choose Mephisto", Jun. 17, 2014.
(Continued)

*Primary Examiner* — Ted Kavanaugh
(74) *Attorney, Agent, or Firm* — Quinn IP Law

(57) ABSTRACT

An article of footwear has a sole assembly with a cushioning component and a shell that has a textile layer. The cushioning component is positioned in a cavity of the shell so that the cushioning component is supported on a lower surface by the shell and the upper surface of the cushioning component is uncovered by the shell at an opening of the shell. A method of manufacturing an article of footwear includes forming an at least partially textile shell so that the shell has a cavity with an opening. A cushioning component is positioned in the cavity of the shell so that a lower surface of the cushioning component is supported on an inner surface of the shell and is uncovered by the shell at the opening. The lower surface of the cushioning component is secured to the inner surface of the shell by radio frequency welding or adhesive.

32 Claims, 10 Drawing Sheets

(51) Int. Cl.

| | |
|---|---|
| ***A43B 13/02*** | (2006.01) |
| ***A43B 13/04*** | (2006.01) |
| ***A43B 13/12*** | (2006.01) |
| ***A43B 13/14*** | (2006.01) |

(52) U.S. Cl.
CPC ..... *A43B 13/14* (2013.01); *A43B 13/18* (2013.01); *A43B 13/184* (2013.01)

(58) Field of Classification Search
USPC ..... 36/29, 25 R, 28, 30 R, 31, 103, 102, 36/59 C, 153
See application file for complete search history.

(56) References Cited

U.S. PATENT DOCUMENTS

| | | | | |
|---|---|---|---|---|
| 5,195,254 | A | 3/1993 | Tyng | |
| 5,224,278 | A | 7/1993 | Jeon | |
| 5,313,717 | A | 5/1994 | Allen et al. | |
| 5,390,430 | A * | 2/1995 | Fitchmun | B32B 27/12 36/25 R |
| 5,406,723 | A * | 4/1995 | Okajima | A43B 5/14 36/131 |
| 5,755,001 | A | 5/1998 | Potter et al. | |
| 5,930,918 | A | 8/1999 | Healy et al. | |
| 5,979,078 | A | 11/1999 | McLaughlin | |
| 5,996,255 | A * | 12/1999 | Ventura | A43B 7/32 36/30 R |
| 6,082,025 | A | 7/2000 | Bonk et al. | |
| 6,192,606 | B1 | 2/2001 | Pavone | |
| 6,457,262 | B1 | 10/2002 | Swigart | |
| 6,568,102 | B1 | 5/2003 | Healy et al. | |
| 6,845,573 | B2 * | 1/2005 | Litchfield | A43B 13/203 36/141 |
| 6,971,193 | B1 | 12/2005 | Potter et al. | |
| 7,086,179 | B2 | 8/2006 | Dojan et al. | |
| 7,086,180 | B2 * | 8/2006 | Dojan | A43B 13/20 36/29 |
| 7,540,097 | B2 | 6/2009 | Greene et al. | |
| 7,588,654 | B2 | 9/2009 | Schindler et al. | |
| 7,707,745 | B2 * | 5/2010 | Schindler | A43B 7/144 36/29 |
| 7,752,772 | B2 * | 7/2010 | Hatfield | A43B 7/1415 36/29 |
| 8,341,857 | B2 | 1/2013 | Dojan et al. | |
| 8,434,245 | B2 | 5/2013 | Bell et al. | |
| 8,505,214 | B2 | 8/2013 | Lee | |
| 2003/0051373 | A1 | 3/2003 | Goodwin | |
| 2004/0098882 | A1 | 5/2004 | Tuan | |
| 2006/0211318 | A1 * | 9/2006 | Fenzi | A43B 7/32 442/181 |
| 2007/0169376 | A1 * | 7/2007 | Hatfield | A43B 7/1415 36/29 |
| 2007/0169379 | A1 * | 7/2007 | Hazenberg | A43B 13/125 36/102 |
| 2008/0184601 | A1 * | 8/2008 | Hsieh | A43B 5/14 36/30 R |
| 2009/0293305 | A1 | 12/2009 | Pelsue et al. | |
| 2010/0251567 | A1 * | 10/2010 | McInnis | A43B 3/0005 36/29 |
| 2011/0016749 | A1 * | 1/2011 | Callahan | A43B 3/0057 36/103 |
| 2011/0107622 | A1 * | 5/2011 | Schwirian | A43B 5/14 36/30 A |
| 2011/0277346 | A1 * | 11/2011 | Peyton | A43B 13/20 36/29 |
| 2012/0056345 | A1 | 3/2012 | Lee | |
| 2012/0066931 | A1 | 3/2012 | Dojan et al. | |
| 2012/0102783 | A1 | 5/2012 | Swigart et al. | |
| 2012/0167416 | A1 * | 7/2012 | Christensen | A43B 3/0057 36/103 |
| 2013/0061495 | A1 | 3/2013 | Lubart | |
| 2013/0067765 | A1 | 3/2013 | Auger et al. | |
| 2013/0118029 | A1 | 5/2013 | Kim | |
| 2013/0247422 | A1 | 9/2013 | Holt et al. | |

FOREIGN PATENT DOCUMENTS

| | | | |
|---|---|---|---|
| GB | 2462100 | A | 1/2010 |
| JP | 0335701 | U | 4/1991 |
| TW | I262769 | B | 10/2006 |
| TW | I341185 | B | 5/2011 |
| TW | M440010 | U | 11/2012 |
| WO | 0057740 | A1 | 10/2000 |
| WO | 2010137769 | A1 | 12/2010 |
| WO | 2011028070 | A2 | 3/2011 |
| WO | 2011152661 | A2 | 12/2011 |
| WO | 2013148244 | A1 | 10/2013 |

OTHER PUBLICATIONS http://www.sportsshoes.com/support/Nike_technology_-_explained, Aug. 27, 2013.
http://counterkicks.com/2013/05/under-armour-speedform-puts-the-bra-in-performance-footwear/, Sep. 19, 2013.
Inflatable SUP http://youtu.be/vryleQTPfl0 "Red Air Twelve Six Race Inflatable Paddle Board", Jun. 17, 2014.
The Nobody Chair video: http://youtu.be/D0igC3YEUxk "From Plastic Bottle to Nobody Chair", Jun. 17, 2014.
http://gizmodo.com/speedform-under-armour-has-built-a-bra-for-your-feet-510120541, Jun. 17, 2014.
Translated Portions of Office Action for Taiwan Application No. 104101343 dated Mar. 27, 2017.

* cited by examiner

SOLE ASSEMBLY WITH TEXTILE SHELL AND METHOD OF MANUFACTURING SAME

TECHNICAL FIELD

The present disclosure relates to a sole assembly for an article of footwear having a textile shell for supporting a cushioning component, and a method of manufacturing same.

BACKGROUND

Footwear typically includes a sole configured to be located under a wearer's foot to space the foot away from the ground or floor surface. Soles can be designed to provide a desired level of cushioning. Athletic footwear in particular sometimes utilizes polyurethane foam or other resilient materials in the sole to provide cushioning. Fluid-filled bladders are sometimes included in the sole to provide desired impact force absorption, motion control, and resiliency. The incorporation of additional materials and components adds processing steps to the manufacturing of footwear.

SUMMARY

An article of footwear is provided that has a sole assembly with a cushioning component and a shell composed at least partially of a textile layer. The shell forms a cavity with an opening. The cushioning component is positioned in the cavity so that the cushioning component is supported on a lower surface by the shell and the upper surface of the cushioning component is at least partially uncovered by the shell at the opening.

The shell may include many different materials, including a textile such as a ballistic nylon, and/or a fabric netting, which may be stretched in a predetermined direction to provide desired performance characteristics. The shell may include a thermoplastic urethane fused with the textile layer.

The shell is configured so that the shell and cushioning component are positioned relative to one another without adhesives or solvents. The cushioning component may be any resilient component, such as a bladder element, a foam layer, or mechanical cushioning elements. The shell may be configured to have greater compliance under vertical loading than under lateral loading. The cushioning component is configured to have desired performance characteristics with respect to the attenuation of vertical loads.

The article of footwear is manufacturable according to a relatively simple and efficient method. A method of manufacturing an article of footwear includes forming an at least partially textile shell so that the shell has a cavity with an opening. Under the method, a cushioning component is positioned in the cavity of the formed shell so that a lower surface of the cushioning component is supported on an inner surface of the shell and is at least partially uncovered by the shell at the opening. The lower surface of the cushioning component is then secured to the inner surface of the shell by radio frequency welding or adhesive.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items.

Those having ordinary skill in the art will recognize that terms such as "above," "below," "upward," "downward," "top," "bottom," etc., are used descriptively for the figures, and do not represent limitations on the scope of the invention, as defined by the claims.

The above features and advantages and other features and advantages of the present disclosure are readily apparent from the following detailed description of the best modes for carrying out the concepts of the disclosure when taken in connection with the accompanying drawings.

DETAILED DESCRIPTION

Figure 1:
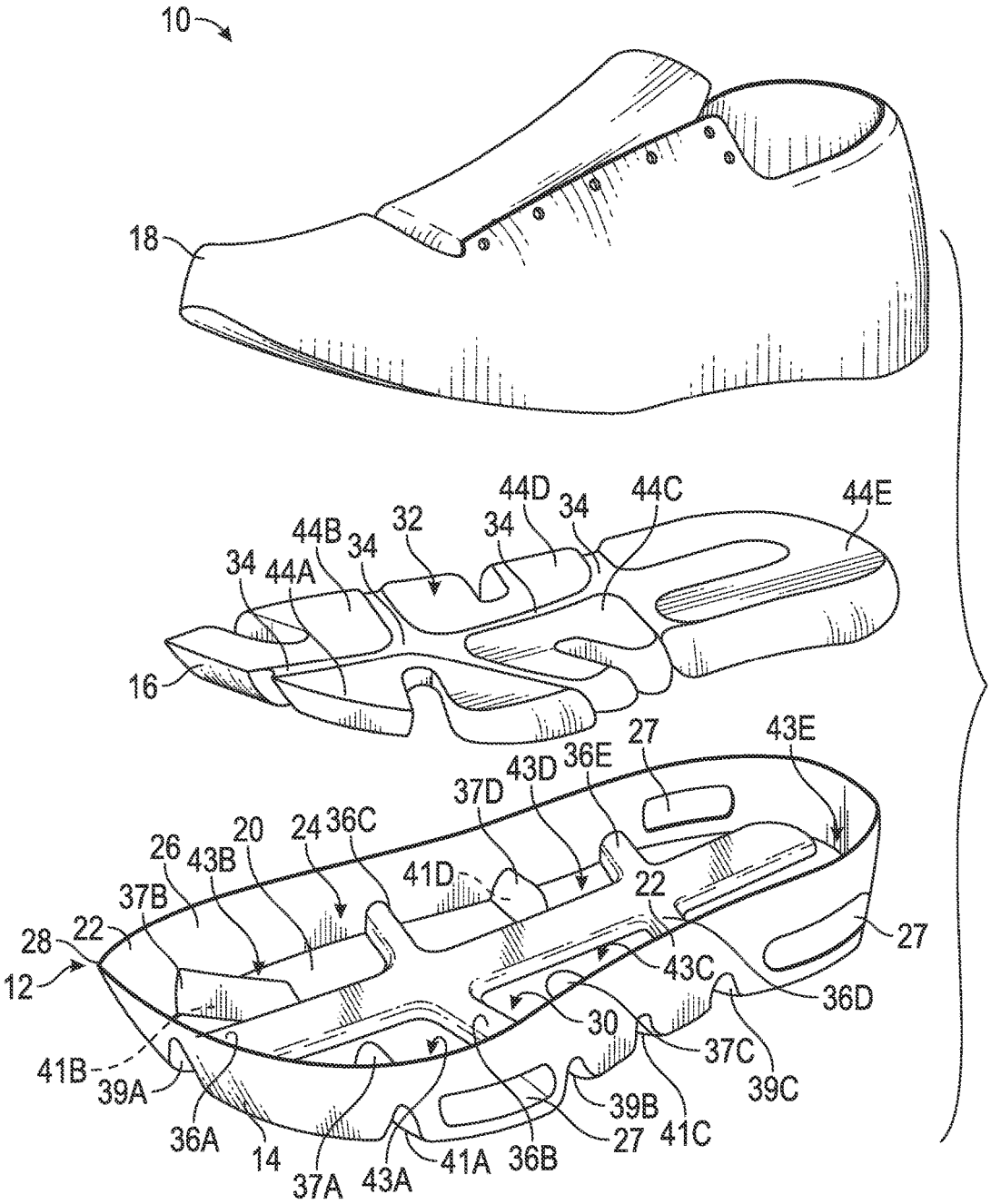
FIG. 1 is a schematic illustration in exploded perspective view of an embodiment of a sole assembly including a multi-layer carrier shell for an embodiment of an article of footwear.
Figure 2:
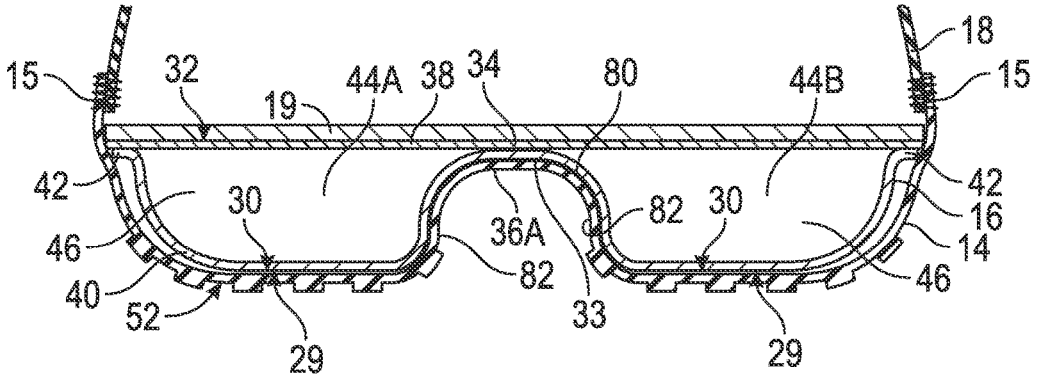
FIG. 2 is a schematic illustration in cross-sectional view of the article of footwear of FIG. 1 taken at lines 2-2 in FIG. 3.

Referring to the drawings, wherein like reference numbers refer to like components throughout the several views, FIG. 1 is an exploded perspective view of an embodiment of an article of footwear 10 with a sole assembly 12 that includes a carrier shell 14 composed at least partially of a textile layer. The shell 14 is configured to support and carry a cushioning component 16. As further explained herein, the cushioning component 16 and shell 14 are formed separately, and the cushioning component 16 is placed in the shell 14. The shell 14 and cushioning component 16 are then secured to one another by radio frequency (RF) welding or adhesive. In some embodiments, as discussed with respect to FIGS. 8-11, a shell 114 extends upward to include a footwear upper. In the embodiment shown in FIG. 1, a footwear upper 18 is separate from the shell 14, and is secured at a periphery of the shell 14 by stitching 15, as shown in FIG. 2. Alternatively, heat seaming, bonding, or other suitable methods of securing the footwear upper 18 to the shell 14 can be used to attach the footwear upper 18 to the shell 14. Accordingly, when RF welding is used, no adhesives or solvents are used in assembling the articles of footwear described herein, such as article of footwear 10.

In some embodiments, the footwear upper 18 can include an overlaying component, such as a strobel unit 19 (shown in FIG. 2), that can also be secured to the shell 14 and cushioning component 16 simultaneously by the RF welding or by adhesive. The strobel unit 19 can be stitched or otherwise secured to the side portions of the footwear upper 18 and can overlay and be secured to the upper surface 32 of the cushioning component 16. The footwear upper 18 may include multiple textile layers hot-melted together with TPU or polymer foam. A fabric net can also be integrated in the footwear upper 18, and stretched as desired prior to hot-melting the upper components to one another, thereby affecting elasticity in various areas as desired.

The shell 14 is configured to maintain the three-dimensional shape shown in FIG. 1 when free-standing. The shell 14 has a bottom 20 and a peripheral sidewall 22 extending upward from the bottom 20 to define a cavity 24 with an opening 26 at the upper edge 28 of the sidewall 22, similar to a shallow bowl. When the cushioning component 16 is positioned in the cavity 24 so that a lower or bottom surface 29 of the cushioning component 16 is supported on an inner surface 30 of the shell 14 as shown in FIG. 2, the shell 14 surrounds and encases the cushioning component 16 only from the bottom 20 and sidewalls 22. The shell 14 may also be referred to as a carrier or capsule that partially encases the cushioning component 16. The upper surface 32 of the cushioning component 16 is at or near the opening 26, and is not covered by the shell 14 at the opening 26. The shell 14 can have open portions forming windows 27 allowing visibility of the cushioning component 16 from the exterior of the article of footwear 10.

As further discussed herein, the cushioning component 16 can be secured to the shell 14 by RF welding at an interface 33, along the bottom surface 29 of the cushioning component 16, such as where a web portion 34 of the cushioning component 16 is seated on a raised ridge 36A of the shell 14.

In the embodiment shown, the cushioning component 16 is a fluid-filled bladder element formed from a first polymeric sheet 38 and a second polymeric sheet 40 joined at a peripheral flange 42 and at the web portion 34. The flange 42 and the web portion 34 define and bound a pattern of separate descending protrusions 44A, 44B, 44C, 44D, 44E of the cushioning component 16 that each form a separate internal cavity 46. The protrusions 44A-44E are fluid-filled with a gas such as air, and are impermeable to the escape of the gas. The protrusions 44A-44E are also referred to as pods. The web portion 34, flange 42, and protrusions 44A-44E are formed in a mold by thermoforming with vacuuming to separate the sheets 38, 40 at the protrusions 44A-44E. The mold is configured to compress the sheets 38, 40 at the flange 42 by a pinch seam, and to join the sheets 38, 40 by compression at the web portion 34. The pinch seam flange 42 allows the upper sheet 38 to remain relatively flat to provide a smooth foot-receiving surface, while the protrusions 44A-44E of the lower sheet 40 descend downward relative to the upper sheet 38 and the flange 42. Such a pinch seam is referred to as an upper pinch seam.

The shell 14 is configured to form ridges at the inner surface 30 that extend upward toward the opening 26 and at least partially separate the cavity 24 into compartments arranged in a predetermined pattern. For example, the ridge 36A extends longitudinally in the shell 14 and is contiguous with laterally extending ridges 36B, 36C, 36D, and 36E. Additional ridges 37A, 37B, 37C, and 37D are formed in the shell 14. Forming the shell 14 into ridges 36A-36E and 37A-37D creates corresponding flex grooves 39A-39C and 41A-41D in the shell 14 at the underside of the ridges 36A-36E and 37A-37D, on the outer surface 52 of the shell 14. The ridges 36A-36E extend further toward the opening 26 than do the ridges 37A-37D. Accordingly, flex grooves 39A, 39B, and 39C formed by the ridges 36A-36E are deeper than flex grooves 41A, 41B, 41C, 41D formed by the ridges 37A-37D. The flex grooves 39A-39C can be referred to as primary or full-depth flex grooves, as they are configured to correspond with ridges 36A-36E that extend sufficiently upward toward the opening 26 to be equal to the depth of the protrusions 44A-44E of the cushioning component. The flex grooves 41A-41D can be referred to as secondary or partial-depth flex grooves.

Accordingly, the ridges 36A-36E separate the shell 14 into individual compartments 43A, 43B, 43C, 43D, and 43E for each of the protrusions 44A, 44B, 44C, 44D, 44E, respectively, with only the web portion 34 extending over and resting on the upper surface 32 (i.e., the crest) of each corresponding ridge 36A-36E. The individual compartments 43A, 43B, 43C, 43D, and 43E are subcavities of the cavity 24. The ridges 37A, 37B, 37C, 37D interfit with the profile of a respective one of the protrusions 44A-44E of the cushioning component 16, but do not interfit with the web portion 34 between the pods.

As is apparent in FIG. 1, a first portion of the cushioning component 16, the protrusion 44A, is configured to fit into the compartment 43A, with the ridge 36A interfitting with the protrusion 44A, and the ridges 36A, 36B corresponding with lateral components of the web portion 34 that bounds the first protrusion 44A. Protrusions 44B, 44C, 44D, and 44E fit similarly into compartments 43B, 43C, 43D, and 43E, respectively. In other words, the protrusion 44A can be referred to as a first protrusion that fits into the first compartment 43A, and the protrusion 44B can be referred to as a second protrusion that is contiguous with the first protrusion and configured to fit into the second compartment 43B. The protrusion 44E is generally U-shaped to provide desired performance characteristics at the heel region of the article of footwear 10.

In an embodiment in which the cushioning component 16 is a bladder element, the cushioning component 16 can be formed from a variety of materials including various polymers that can resiliently retain a fluid such as air or another gas. Examples of polymer materials for the bladder element 16 include thermoplastic urethane, polyurethane, polyester, polyester polyurethane, and polyether polyurethane. Moreover, the bladder element 16 can be formed of layers of different materials. In one embodiment, the bladder element 16 is formed from thin films having one or more thermoplastic polyurethane layers with one or more barriers layers of a copolymer of ethylene and vinyl alcohol (EVOH) that is impermeable to the pressurized fluid contained therein as disclosed in U.S. Pat. No. 6,082,025 to Bonk et al., which is incorporated by reference in its entirety. Bladder element 16 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The bladder element 16 may also be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the bladder element 16 are disclosed in U.S. Pat. Nos. 4,183,156 and 4,219,945 to Rudy, which are incorporated by reference in their entireties. Further suitable materials for the bladder element 16 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the bladder element 16, engineering properties such as tensile strength, stretch properties, fatigue characteristics, dynamic modulus, and loss tangent can be considered. The thicknesses of sheets of materials used to form the bladder element 16 can be selected to provide these characteristics.

When the cushioning component is a bladder element 16, it is resilient and provides cushioning and flexibility that can be tuned such as by selecting a level of pressurization. Tensile members and/or reinforcing structures can be integrated with the bladder element 16 to provide desired responsiveness, such as disclosed in U.S. Pat. No. 4,906,502 to Rudy et al., and U.S. Pat. No. 8,061,060 to Swigart et al., which are incorporated by reference in their entireties.

Figure 14C:
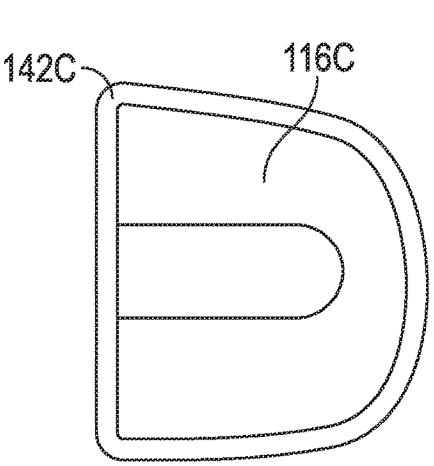
FIG. 14C is a schematic illustration in plan view of a third cushioning component.
Figure 14B:
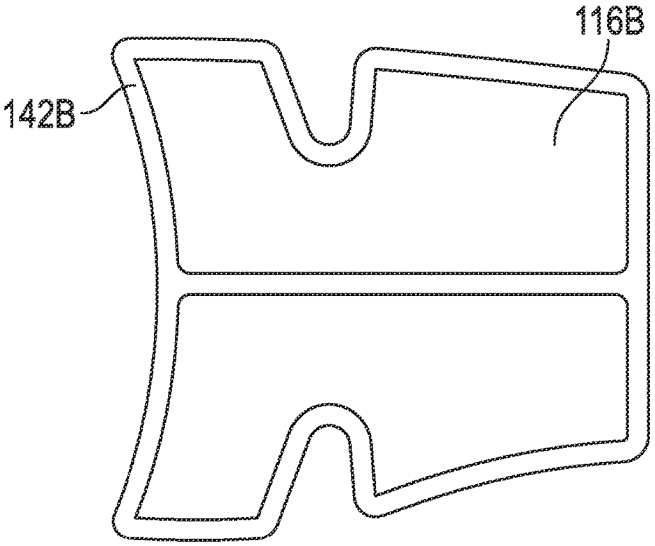
FIG. 14B is a schematic illustration in plan view of a second cushioning component.
Figure 14A:
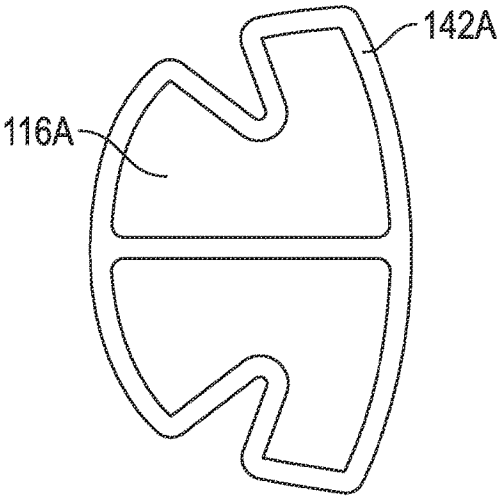
FIG. 14A is a schematic illustration in plan view of a first cushioning component.
Figure 15:
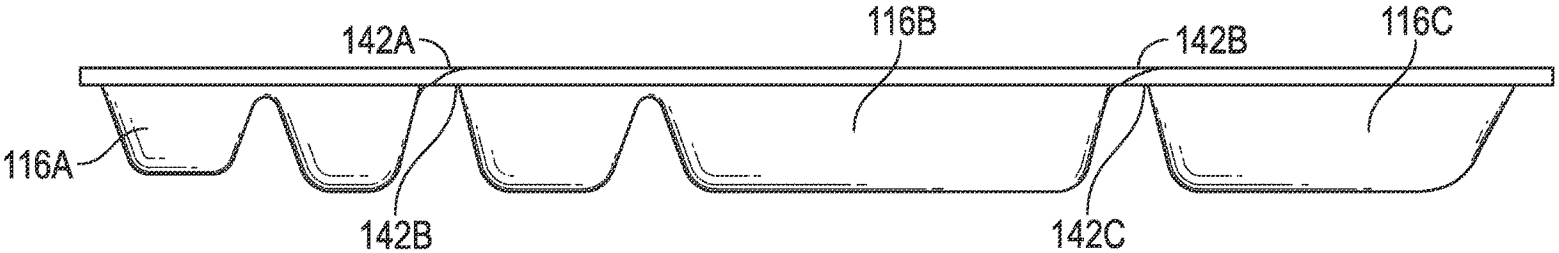
FIG. 15 is a schematic illustration in side view of a bladder element that includes the cushioning components of FIGS. 14A-14C.

In other embodiments, multiple cushioning components that are separate bladder elements can be placed into the shell 14 so that peripheral flanges of the bladder elements overlap. The separate cushioning components can then be joined by bonding at the overlapping flanges due to heat and pressure during thermoforming. For example, referring to FIGS. 14A-14C, three separate bladder elements 116A, 116B, 116C can be placed adjacent one another, such as when placed in the cavity 24 of the shell 14 of FIG. 1, so that a peripheral flange 142A of the bladder element 116A overlaps a peripheral flange 142B of bladder element 116B. Peripheral flange 142B of bladder element 116B also overlaps peripheral flange 142C of bladder element 116C, as shown in FIG. 15. Accordingly, during forming of the article of footwear according to the method of FIG. 16, the overlapping flanges 142A, 142B and 142B, 142C will rest along the ridges 36A-36E of the shell 14, and will be compressed together by the RF tooling assembly 210 of FIG. 13, creating an integral cushioning component 116 of FIG. 15. Utilizing separate bladder elements such as 116A, 116B, 116C for different portions of a completed cushioning component 116 enables economies of scale. For example, the cushioning component 116A aligned with the toe region of the article of footwear, and the cushioning component 116C aligned with the heel region of the article of footwear can be used in cushioning components of different sized shoes by utilizing different size intermediate bladder elements 116B to interconnect the bladder elements 116A, 116C, resulting in a longer or wider cushioning component 116 as desired for a predetermined foot size specification.

In other embodiments, as an alternative to one or more fluid-filled bladder elements, the cushioning component 16 can be formed from foam, polymeric beads, or resilient mechanical components that provide cushioning. When formed from foam or polymeric beads, the cushioning component 16 can have the same shape as shown in FIG. 1, with the separate protrusions 44A-44E formed by any suitable method, such as compression molding of the foam or bead material.

Figure 7:
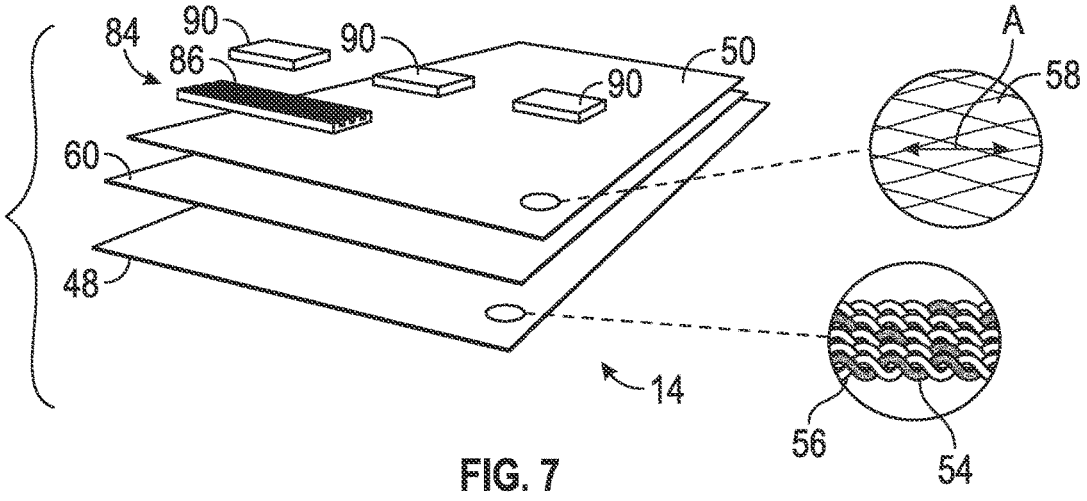
FIG. 7 is a schematic illustration in exploded view of components of the shell of FIG. 1.

Referring to FIG. 7, the shell 14 may be formed of multiple layers of materials and components, including at least one textile layer 50. As used herein, a textile layer is a layer that may include multiple materials, one of which is a woven fabric. For example, the shell 14 may be composed of at least one textile or fabric, and at least one polymer. FIG. 7 shows one embodiment of multiple layers and materials used to form the shell 14. As arranged in FIG. 7, an inner textile layer 48 forms the inner surface 30 of the formed shell 14, and an outer textile layer 50 forms a portion of an outer surface 52 of the formed shell 14 configured to be a ground-contacting surface. It is noted that in FIG. 7, the components are shown in the opposite order top to bottom as they would be when arranged as the formed shell 14, or when assembling them over a lower tool 214 of FIG. 13 (also referred to as a mold portion) in forming the shell 14 or 114.

In the example embodiment of FIG. 7, by way of non-limiting example, the inner textile layer 48 includes woven threads of a first material 54, interwoven with threads of thermoplastic urethane (TPU) 56. During forming of the shell 14, the multiple layers are compressed together and heated, as described with respect to FIG. 17, causing the TPU threads to melt and the TPU material to disperse throughout the layers, helping to fuse the layers and components of the shell 14 to one another. When the TPU threads melt, the weave of the remaining material 54 may be a netting or any other suitable weave.

The outer textile layer 50 is formed of the same at least partially textile material or of a different material, which may be at least partially textile, and may be arranged as a fabric netting 58. As shown, the netting 58 is stretched in the directions of the double-sided arrow A during forming of the shell 14. The stretched netting 58 will provide resistance to flexing of the shell 14 in response to forces applied against the netting 58. For example, if the layers are positioned so that the direction of stretching is vertically along the sidewalls 22 of the shell 14, then the stretched netting 58 will resist lateral motion of the shell 14 in comparison to unstretched netting. The netting 58 also functions as a rip-stop when joined with the other materials of the shell 14.

The inner textile layer 48 interfaces with the cushioning component 16 in the assembled article of footwear 10. Accordingly, the inner textile layer 48 may be selected to reduce abrasion and minimize frictional squeak in interfacing with the cushioning component 16. The outer textile layer 50 may interface with a ground surface. Accordingly, the outer textile layer 50 may be selected to provide a predetermined level of abrasion resistance, flexibility, durability, water resistance, and other characteristics. Non-limiting examples of materials that may be used for the textile layers 48, 50 include a thermal plastic urethane such as Aeroply, made of recycled bladder elements, KEVLAR®, i.e., an aramid fiber, or a ballistic nylon. KEVLAR® is a registered trademark of E.I. du Pont de Nemours and Company of Wilmington, Delaware. The textile layers 48, 50 may have selected knit formations, such as a circular knit or a warped knit, or may be configured as a netting.

FIG. 7 shows an optional middle layer 60 positioned between the inner textile layer 48 and the outer textile layer 50. Although represented as a sheet in FIG. 7, the middle layer 60 can be a composition of different materials, and can have a specific, non-flat, three-dimensional shape. The middle layer 60 can be foam, injected structural components, such as plastics, ply fibers, and other materials or components, or a mixture of some or all of these components, to provide predetermined, desirable lateral/shear resistance dynamics and desired compliance under loading in the vertical direction.

Figure 3:
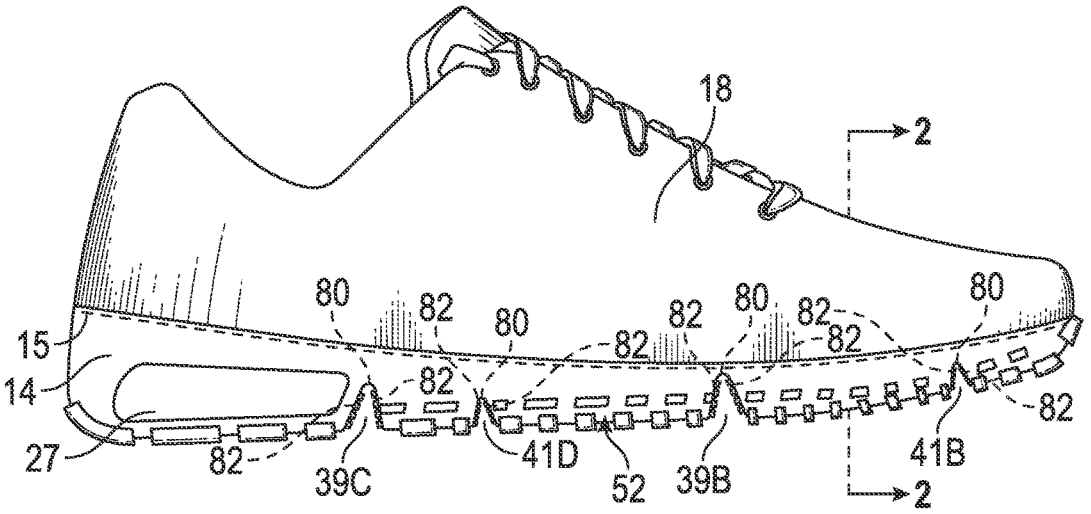
FIG. 3 is a schematic illustration in side view of the article of footwear of FIG. 1.

The shell 14 can be formed so that different portions of the shell 14 have different desired strengths or stiffnesses. For example, the various layers and components of the shell 14 can be joined by heat, vacuum, and compression in a two-piece mold assembly 62 shown in FIG. 12. The mold assembly 62 includes a first mold portion 64A and a second mold portion 64B. The mold portion 64A is configured to define a mold cavity 66 having raised portions 68A-68E corresponding with the flex grooves 39A-39C, and raised portions 70A-70D corresponding with the flex grooves 41A-41D. The mold portion 64B has raised portions 72A-72C corresponding with the ridges 36A-36E. The mold portion 64B also has raised portions 74A-74D corresponding with the ridges 37A-37D. The mold portion 64A has air openings 76 along a lower surface of the mold 64A at which a vacuum is applied while forming the shell 14. The multiple layers of the shell 14 are stacked between the mold portions 64A, 64B across the cavity 66, and the mold portion 64B is lowered onto the mold portion 64A. The mold portions 64A, 64B can be connected to a robotic assembly that automatically mates the mold portions 64A, 64B and provides varying amounts of net downward pressure along different portions of the mold portion 64B. The resulting shell 14 will have areas with a greater density where greater pressure is applied during molding. The mold portion 64B can also be configured to provide greater space between some areas of the first mold portion 64A than others, so that a uniform downward pressure on the mold portion 64A will compress different areas of the layers of shell component to a different extent, resulting in different densities. In one embodiment, first portions or regions of the shell 14 along the walls 82 of each ridge can be compressed to have a first density, as indicated in FIGS. 2 and 3, and second portions or regions of the shell 14 at the crests 80 of the ridges 36A-36E can be compressed to have a greater second density. Such a configuration enables the shell 14 to be more compliant under vertical loading (i.e., under a downward load on a crest 80), than under lateral loading (i.e., under a side load along a length of a crest 80). The shell 14 will exhibit greater strength and stiffness (i.e., less compliance) in the high density areas.

Figure 4:
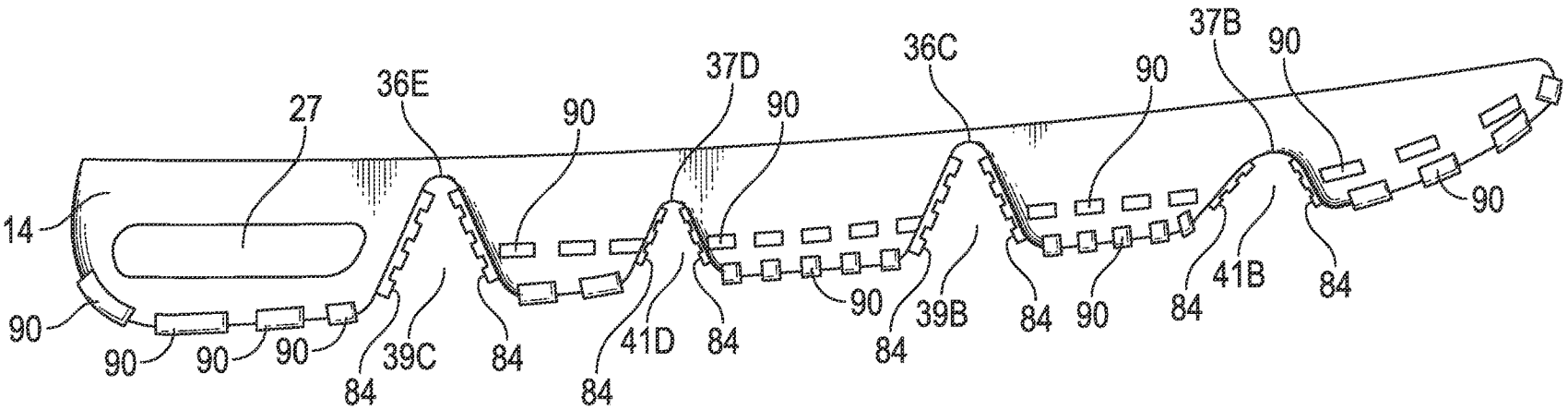
FIG. 4 is a schematic illustration in side view of the shell of FIG. 1.

Another example mechanism to configure the shell 14 to be more compliant under vertical loading than under lateral loading is the inclusion of reinforcing members 84 secured to the outer surface 52 of the shell 14 along the laterally-extending flex grooves such as flex grooves 39B, 39C, 41B, and 41D as shown in FIG. 4. The reinforcing members 84 are secured to the walls 82 of the ridges, but not to the crests 80. Each reinforcing member 84 includes a plurality of elongated slats 86 interconnected by a relatively thin webbing 88, serving as a backing. The reinforcing members 84 are positioned in the shell 14 so that the slats 86 run generally transversely along the walls 82. The slats 86 are thicker than the webbing 88. The slats 86 prevent movement of the shell 14 under shear loading (i.e., under loading applied generally transversely along the length of the slats 86). However, the webbing 88 collapses relatively easily under vertical loading, causing the slats 86 positioned higher than others to collapse downward toward the other slats 86 along with the remaining shell material. The reinforcing members 84 thus enable the shell 14 to resist lateral compression at the reinforcing member 84, and provide compliance under vertical loading by movement of the slats 86 toward one another. The reinforcing members 86 may be a semi-rigid polymer with a hardness in the Shore A range. One reinforcing member 84 is shown for purposes of illustration in FIG. 7 positioned at the outer surface of the outer textile layer 50. During forming, the reinforcing members 84 can instead be positioned between the layers 48, 50, along with other components of the middle layer 60, so that the outer textile layer 50 overlays the reinforcing members 84, with the slats 86 extending outward. By configuring the shell 14 to be compliant under vertical loads, the cushioning component 16 can be tuned to attenuate vertical loading in a desired manner.

Additional support members 90 can be included with the multiple layers and formed therewith so that the support members 90 extend at the bottom surface 52 of the shell 14. The support members 90 can be of a high durability rubber or other high wear material, and can function as outsole elements on the shell 14. Like the reinforcing members 84, the support members 90 can be placed between the layers 48, 50 during forming of the shell 14, or can be placed outward of the textile layer 50. In either instance, materials such as the diffused TPU in the shell 14 can secure the members 84, 90 to the other shell components. Still further, the support members 90 could be secured to the shell 14 after molding of the other layers of the shell 14.

Figure 8:
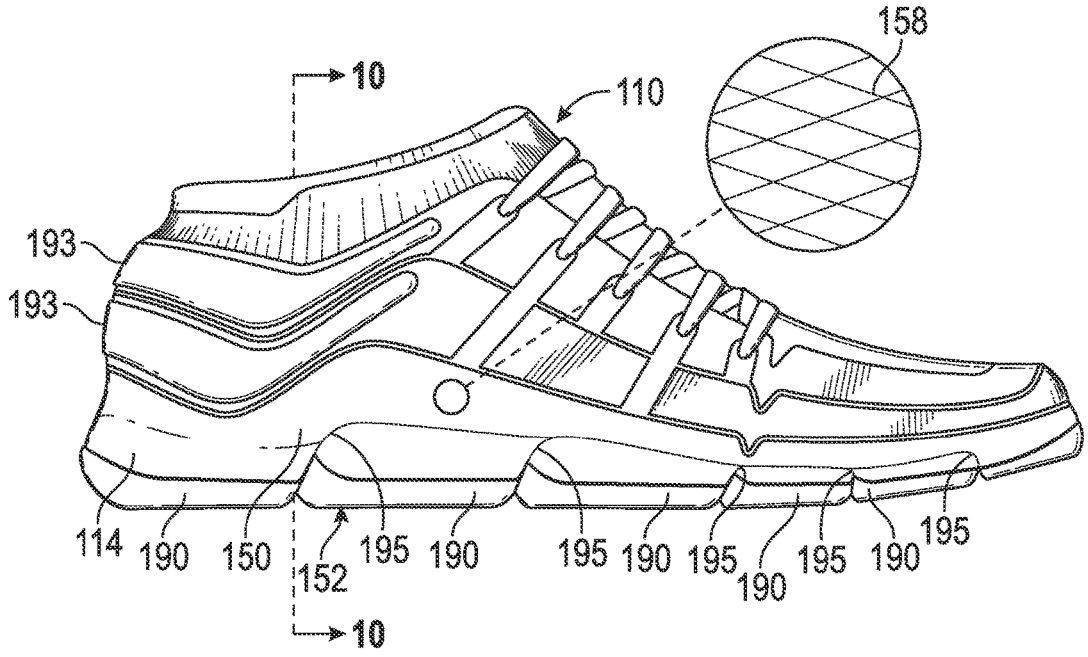
FIG. 8 is a schematic illustration in side view of an alternative embodiment of an article of footwear having a carrier shell.
Figure 9:
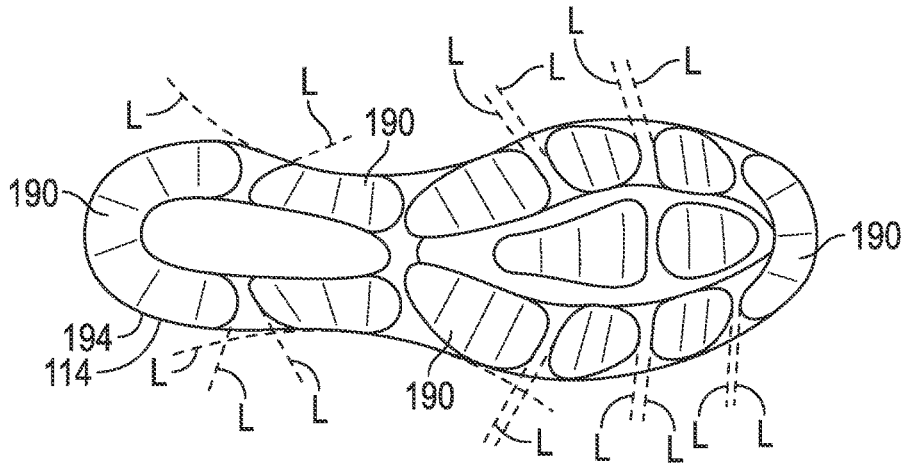
FIG. 9 is a schematic illustration in bottom view of the article of footwear of FIG. 8.
Figure 10:
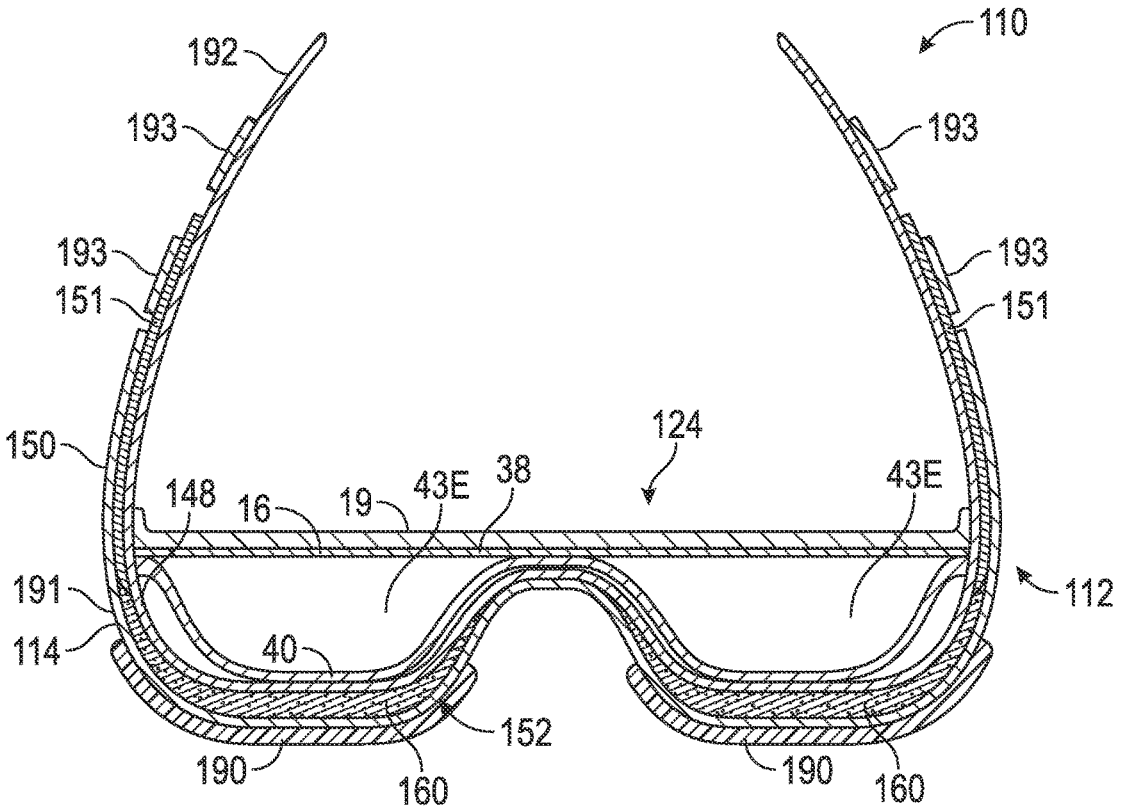
FIG. 10 is a schematic illustration in cross-sectional view of the article of footwear of FIG. 8 taken at lines 10-10 in FIG. 8.

FIGS. 8-11 show an alternative embodiment of an article of footwear 110 with a sole assembly 112 that has a multi-layer shell 114 that can be formed from the variety of materials discussed with respect to shell 14, including at least one textile layer. The shell 114 is configured to have both a lower portion 191 extending around and below the cushioning component 16, and an upper portion 192 that extends from the lower portion 191 above the cushioning component 16 to form an integral footwear upper. The shell 114 has an inner textile layer 148 and one or more outer textile layers 150, 151 with a middle layer 160 captured between the layers 148, 150 as shown in FIG. 10. The upper portion 192 forming the upper may be the inner layer 148. The exposed part of the lower portion may be the outer textile layer 150. The middle layer 160 in the embodiment shown is a foam that can be blown between the layers 148, 150 during forming in a mold assembly such as mold assembly 62. For example, the middle layer 160 can be a polymer foam material such as polyurethane or ethylene vinyl acetate (EVA). As indicated in FIG. 8, the outer textile layer 150 includes a stretched netting 158, and the various exposed layers are of different types of weaves.

Support members 193 surround the heel area of the upper portion 192. The support members 193 can be plastic or another suitable material. Additional support members 190 can be included with the multiple layers and formed therewith so that the support members 190 extend at the bottom surface 152 of the shell 114. The support members 190 can be of a high durability rubber or other high wear material, and can function as outsole elements on the shell 114. The support members 190 can be placed between the layers 148, 150 during forming of the shell 114, or can be placed outward of the outer textile layer 150. In either instance, materials such as the diffused TPU in the shell 114 can secure the members 190 to the other shell components. Still further, the support members 190 could be secured to the shell 114 after molding of the other layers of the shell 114.

Figure 11:
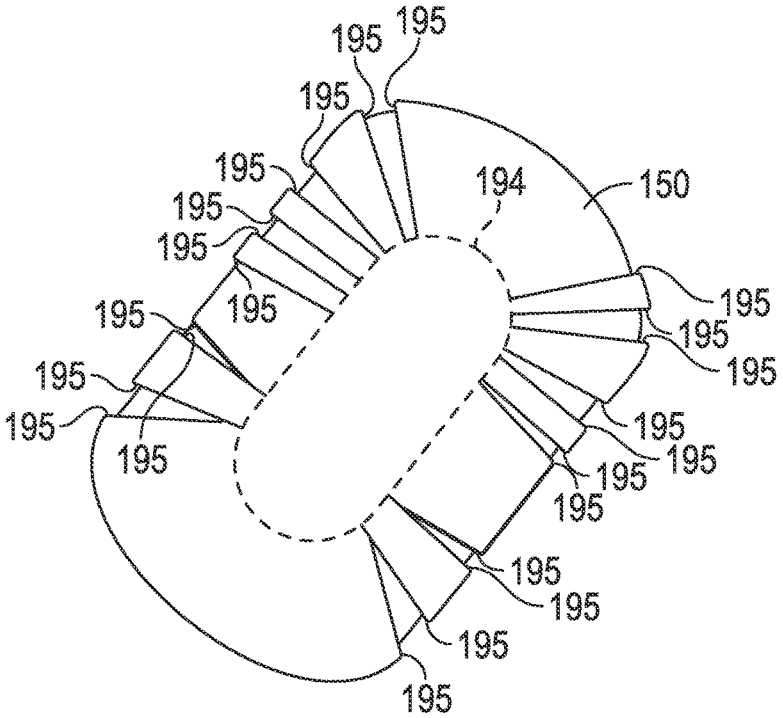
FIG. 11 is a schematic illustration in plan view of a textile layer of the shell of FIGS. 8-10 prior to forming the shell.

The shell 114 is pleated at a transition from a bottom surface 152 to the sides of the lower portion 191. Sample pleats 195 are shown in FIG. 11. The transition at which the folds of the pleats 195 overlay is the perimeter 194 of the bottom surface 152 of the outer textile layer 150 of the formed shell 114, as indicated in FIG. 9. The perimeter 194 includes flex locations of the sole assembly 112. The fold lines of the pleats 195 of FIG. 11 are indicated at phantom lines L in FIG. 9. Pleating the layers of the shell 114 aids in the construction of the shell 114, allowing it to extend both under the cushioning component 16, forming a cavity 124 in which the cushioning component 16 is received, as well as to extend upward to form the upper portion 192 and to flex at the transition. The shell 114 thus serves as a carrier for the cushioning component 16 and as an integral footwear upper.

Figure 12:
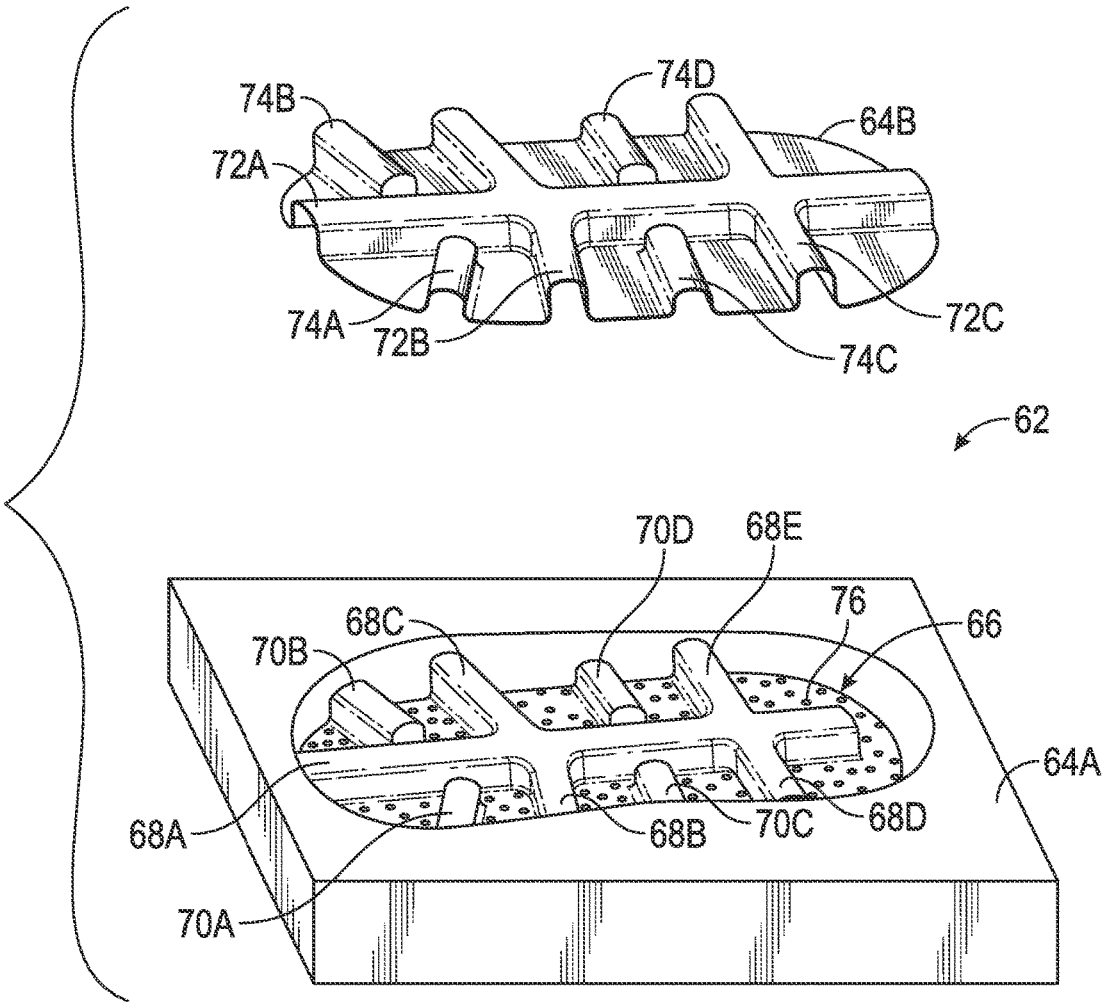
FIG. 12 is a schematic illustration in exploded perspective view of a mold assembly for forming the shell of FIG. 1.
Figure 13:
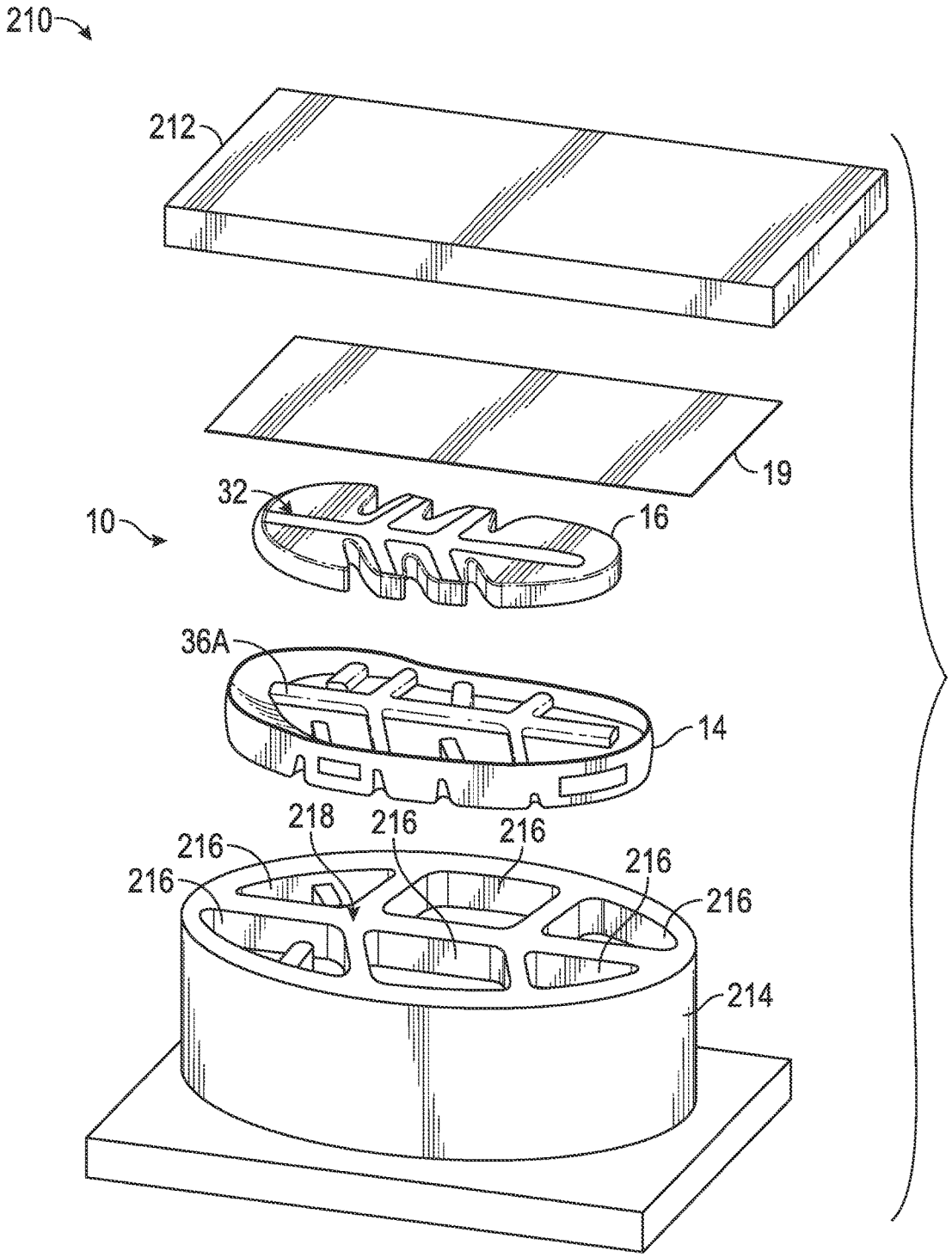
FIG. 13 is a schematic illustration in exploded perspective view of a tooling assembly for forming the article of footwear of FIG. 1.
Figure 16:
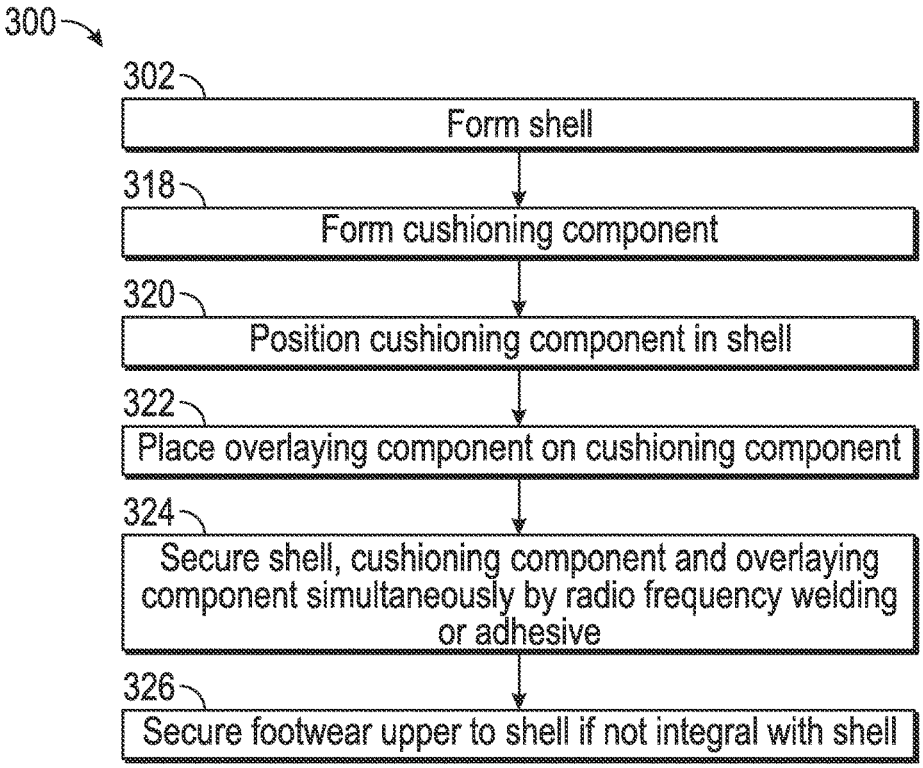
FIG. 16 is a flow diagram of a method of manufacturing an article of footwear including a multi-layer carrier shell.

FIG. 13 shows a tooling assembly 210 for forming the article of footwear 10 or 110 according to the method 300 described with respect to FIG. 16. The components of the article of footwear 10 are shown in exploded view between an upper tool 212 and a lower tool 214. Specifically, an overlaying component, such as the strobel unit 19, the formed cushioning component 16 and the formed shell 14 are stacked between the tools 212, 214. The shell 14 is already formed according to the method described with respect to FIG. 17, using the mold assembly 62 of FIG. 12. FIG. 12 shows the mold assembly 62 in exploded view. The second mold portion 64B is sized to fit over the cavity 66 of the first mold portion 64A. The cushioning component 16 is also in a preformed state. Accordingly, if the cushioning component 16 is a bladder element, the fluid-filled compartments are inflated prior to forming the article of footwear 10 in the tooling assembly 210.

The lower tool 214 has cavities 216 and an upper face 218 arranged in a pattern to receive the bottom of the shell 14 so that portions of the upper face 218 extending between the cavities 216 interfit in the flex grooves 39A-39C of the shell 14 (labeled in FIG. 1). The crests 80 of each ridge 36A-36E straddles the upper face 218 and the walls 82 of each ridge 36A-36E extend downward into the cavities 216. The cushioning component 16 is then received in the shell 14 so that the web portion 34 interfaces with the ridges 36A-36E, as described with respect to FIG. 1. The strobel unit 19 is positioned over the upper surface 32 of the cushioning component 16. The upper tool 212 is then compressed downward on the assembled article of footwear 10. RF energy is supplied to the tools 212, 214 to weld the web portion 34 to the ridges 36A-36E. The bottom surface of the cushioning component 16 rests on the inner surface 30 of the shell 14. The sides of the cushioning component 16 are not welded to the shell 14. Accordingly, the cushioning component 16 is welded to the shell 14 only at the web portion 34, but in other portions is only supported in the shell 14. Although a slight space is shown between the shell 14 and the sides of the cushioning component 16 in FIG. 2, the cushioning component 16 may be configured to have a 1:1 fit or an interference fit with the shell 14. Because the cushioning component 16 is not fixed on all surfaces to the shell 14, the cushioning component can at least partially compress and deform separately from the shell 14 and return to an uncompressed state under loading. The shell 14 thus supports and carries the cushioning component 16, but does not constrain it as foam would in a conventional sole assembly in which the bladder element is formed simultaneously with surrounding foam in a mold assembly.

Figure 17:
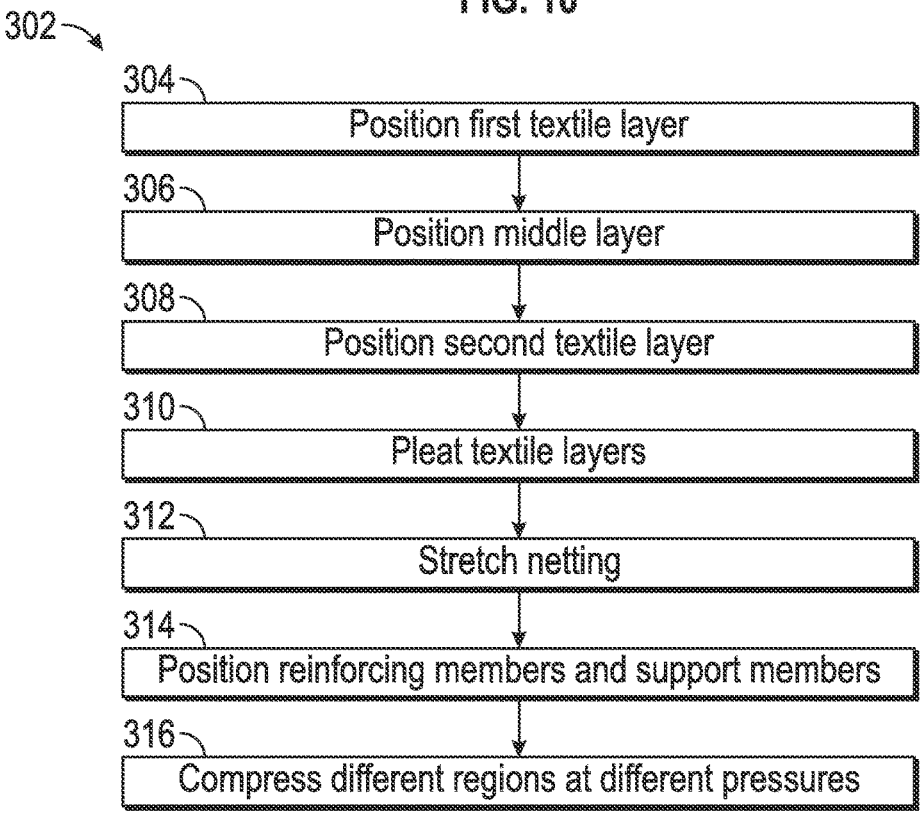
FIG. 17 is a flow diagram of a method of forming the multi-layer carrier shell used in the method of FIG. 16.

Referring to FIG. 16, a method 300 of forming an article of footwear such as article of footwear 10 or 110 is shown in a flow diagram. The method 300 includes step 302, forming the shell 14 or 114. Step 302 has multiple sub-steps, as shown in further detail in the flowchart of FIG. 17, and may be referred to as a method 302 of forming a multi-layer shell as described herein. Referring to FIG. 17, a method 302 of forming the shell 14 or 114 includes sub-step 304, positioning a first textile layer, such as the outer layer 50 or 150, in or on the mold portion 64A of FIG. 12. In sub-step 306, a middle layer 60 is then positioned adjacent the outer layer 50 or 150 on the mold portion 64A. In sub-step 308, in which a second textile layer, such as inner layer 48 or 148 is positioned over the outer layer 50 or 150. If the middle layer 60 is a foam layer, then sub-step 306 may occur during or after sub-step 316. In other words, the foam layer 60 can be injected between the textile layers 50 or 150, and 48 or 148.

Optionally, forming the shell in method 302 may include pleating the textile layers in sub-step 310. For example, the layers 148 and 150 of the shell 114 are pleated at pleats 195 as described with respect to FIGS. 10 and 11 to extend over a transition at the perimeter 194 to the upper portion 192.

Forming the shell 14 or 114 in method 302 may also include sub-step 312, in which netting 58 or 158 is stretched in a predetermined direction. The netting 58 or 158 must remain stretched during the compressing sub-step 316 in order to capture the stretch configuration of the netting 58 or 158 in the formed shell 14 or 114. The netting 58 or 158 may be integral with one of the textile layers 48, 148, 50, 150

Figure 5:
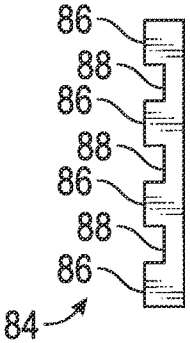
FIG. 5 is a schematic illustration in side view of a reinforcing member of the shell of FIG. 4.
Figure 6:
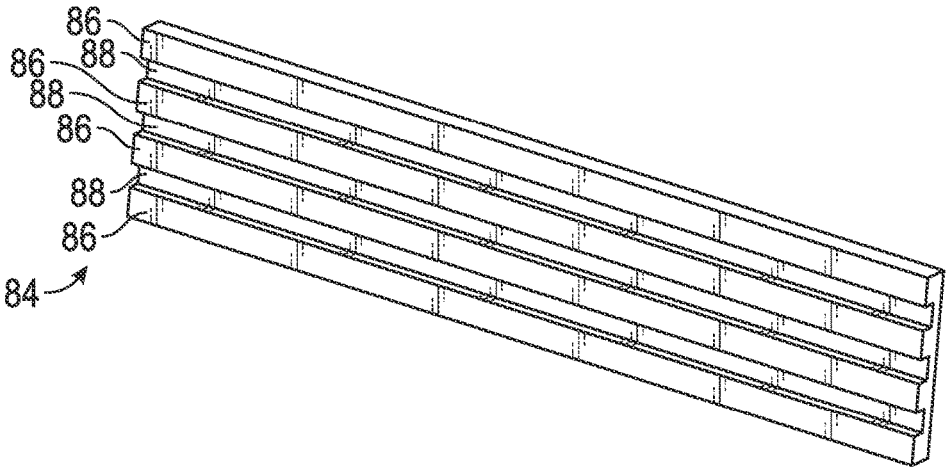
FIG. 6 is a schematic illustration in perspective view of the reinforcing member of FIG. 5.

In optional sub-step 314, any reinforcing members 84 and support members 90, 190, 193 are positioned at predetermined locations in the mold assembly 62 prior to the compressing sub-step 316 so that the formed shell 14 or 114 will have a desired compliance in vertical loading that is greater than a compliance in lateral loading, such as discussed with respect to FIGS. 4-6.

Finally, in sub-step 316, the arranged components of the shell 14 or 114 are compressed in the mold assembly 62 while heating and applying a vacuum to the mold assembly 62, to produce the formed shell 14 or 114. The compression under sub-step 316 is provided at different pressures in different regions of the mold assembly 62 so that the resulting shell 14 or 114 will have different strengths and stiffnesses at different portions. For example, the crests 80 of the ridges 36A-36E are a first region that is relatively stiff compared to the walls 82 (a second region) to enable greater compliance of the shell 14 or 114 under vertical loading than under lateral loading.

Once the shell 14 or 114 is formed, the method 300 of forming the article of footwear 10 or 110 proceeds to step 318 in FIG. 16, forming the cushioning component 16 or 116. If multiple cushioning components 116A, 116B, 116C are used, they are each formed and interconnected in step 318. If the cushioning component 16 or 116 is a bladder element, it is formed by any of the methods described herein, preferably with the upper pinch seam flange 42 as described. Alternatively, the cushioning component 16 or 116 may be obtained in a pre-formed state, in which case the method 300 proceeds from step 302 to step 320.

In step 320, the formed cushioning component 16 or 116 is positioned in the formed shell 14 or 114, as is shown and discussed with respect to FIGS. 1 and 13. An overlaying component can then be placed on the cushioning component 16 or 116 in step 322. For example, the overlaying component may be the strobel unit 19, as shown in FIGS. 10 and 13.

Next, in step 324, the RF tooling 210 is closed by compressing the upper tool 212 against the lower tool 214, with the components of the article of footwear 10 or 110 sandwiched therebetween. RF weld energy is applied, causing the shell 14 or 114, cushioning component 16, and strobel unit 19 to be secured to one another simultaneously at select weld areas as described. Alternatively, the shell 14 or 114, cushioning component 16, and strobel unit 19 can be secured to one another in step 324 by adhesive. Finally, in step 326, the footwear upper 18 is secured to the shell 14, such as by stitching, heat seaming, bonding, or otherwise, unless the upper is formed by the shell as is the case with shell 114.

Accordingly, under the method 300, a relatively lightweight article of footwear 10 or 110 with desirable performance characteristics is assembled in a minimal number of steps and, if RF welding is used, without the use of adhesives or solvents.

While the best modes for carrying out the disclosure have been described in detail, those familiar with the art to which this disclosure relates will recognize various alternative designs and embodiments for practicing the disclosure within the scope of the appended claims. It is intended that all matter contained in the above description or shown in the accompanying drawings shall be interpreted as illustrative only and not as limiting.

The invention claimed is:

1. An article of footwear comprising:

a sole assembly having:

a cushioning component;

a shell composed at least partially of a textile layer, and forming a cavity with an opening; wherein the shell has pleats with folds of the pleats at a perimeter of a bottom surface of the shell; and wherein the cushioning component is positioned in the cavity so that the cushioning component is supported on a lower surface by the shell, an upper surface of the cushioning component is at least partially uncovered by the shell at the opening, and the shell extends upward beyond the upper surface of the cushioning component.

2. The article of footwear of claim 1, wherein the shell includes at least one of a thermoplastic urethane, an aramid fiber, a ballistic nylon, or a fabric netting.

3. The article of footwear of claim 1, wherein the shell is further composed of a thermoplastic urethane fused with the textile layer.

4. The article of footwear of claim 1, wherein the textile layer is a fabric netting stretched in at least one direction.

5. The article of footwear of claim 1, wherein the shell and cushioning component are positioned relative to one another without an adhesive or a solvent.

6. The article of footwear of claim 1, wherein the cushioning component is a bladder element.

7. The article of footwear of claim 1, wherein the shell is configured to form ridges at an inner surface of the shell; wherein the ridges extend toward the opening to at least partially separate the cavity into compartments; and wherein the cushioning component has a first portion configured to fit into a first one of the compartments.

8. The article of footwear of claim 7, wherein the ridges include a longitudinally-extending ridge and laterally-extending ridges; and wherein the longitudinally-extending ridge is contiguous with at least some of the laterally-extending ridges.

9. The article of footwear of claim 8, wherein other ones of the laterally-extending ridges are not contiguous with the longitudinally-extending ridge; and wherein the longitudinally-extending ridge extends further toward an upper edge of the shell than said other ones of the laterally-extending ridges.

10. The article of footwear of claim 9, wherein:

the shell includes a flex groove corresponding with the longitudinally-extending ridge and flex grooves corresponding with said other ones of the laterally-extending ridges; and the flex groove corresponding with the longitudinally-extending ridge is deeper than the flex groove corresponding with said other ones of the laterally-extending ridges.

11. The article of footwear of claim 7, wherein the cushioning component is a first cushioning component, and further comprising a second cushioning component; and wherein the second cushioning component has a second portion configured to fit into a second one of the compartments adjacent to the first cushioning component.

12. The article of footwear of claim 11, wherein the first and the second cushioning components are separate bladder elements.

13. The article of footwear of claim 12, wherein the first and second cushioning components have overlapping flanges; and wherein the overlapping flanges are joined by compression.

14. The article of footwear of claim 7, wherein the first cushioning component has a second portion contiguous with the first portion and configured to fit into a second one of the compartments.

15. The article of footwear of claim 7, wherein the shell has flex grooves at an outer surface of the shell that correspond with the ridges; and wherein the flex grooves are of different depths.

16. The article of footwear of claim 1, wherein the shell is configured to form a pattern of compartments in the cavity; and wherein the cushioning component is configured to form a pattern of protrusions at the lower surface so that the cushioning component interfits with the compartments.

17. The article of footwear of claim 16, wherein the cushioning component is a bladder element formed from two polymeric sheets bonded at a top pinch seam.

18. The article of footwear of claim 1, wherein the shell has a first portion compressed to a first density, and a second portion compressed to a second density greater than the first density so that the shell is stiffer at the second portion than at the first portion.

19. The article of footwear of claim 18, wherein the shell has a first stiffness in vertical loading and a second stiffness in lateral loading; and wherein the first stiffness is less than the second stiffness.

20. The article of footwear of claim 1, wherein the shell has an outer layer, an inner layer and a middle layer between the inner layer and the outer layer; and wherein the outer layer is the textile layer, the inner layer is a second textile layer, and the middle layer is at least partially foam.

21. The article of footwear of claim 20, wherein the shell includes diffused thermoplastic urethane fusing at least one of the outer layer and the inner layer to the middle layer.

22. The article of footwear of claim 1, further comprising:

a footwear upper secured to an upper surface of the cushioning component and to an inner surface of the shell.

23. The article of footwear of claim 1, wherein the shell is a footwear upper that extends around the cushioning component and below the cushioning component.

24. The article of footwear of claim 20, wherein the pleats are at a transition from a lower portion of the shell below the cushioning component to an upper portion of the shell that extends upward beyond the upper surface of the cushioning component, and the pleats extend up at least one of a medial side or a lateral side of the upper portion of the shell.

25. The article of footwear of claim 1, wherein the shell has an outer layer with an outer surface and includes outsole elements secured to the outer surface.

26. The article of footwear of claim 1, wherein the shell has an outer surface with walls and a crest connecting the walls to define a laterally-extending groove; and further comprising:

reinforcing members secured to the outer surface and extending along the walls and not along the crest; wherein the reinforcing member has laterally-extending slats and has a webbing that interconnects the slats; wherein the webbing is thinner than the slats, the shell thereby resisting lateral compression at the reinforcing member and providing compliance under vertical loading by movement of the slats toward one another.

27. The article of footwear of claim 1, wherein the cushioning component is secured to the shell only at an interface of a web portion of the lower surface of the cushioning component and a raised ridge of an inner surface of the shell.

28. The article of footwear of claim 1, wherein the shell includes an outer layer, an inner layer, and support members extending at the bottom surface of the shell.

29. An article of footwear comprising:

a sole assembly having:

a cushioning component;

a shell composed at least partially of a textile layer, and having a cavity with an opening;

support members extending at a bottom surface of the shell;

wherein:

the cushioning component is positioned in the cavity so that the cushioning component is supported on a lower surface by the shell, an upper surface of the cushioning component is at least partially uncovered by the shell at the opening, and the shell extends upward beyond the upper surface of the cushioning component;

the shell is a footwear upper that extends around the cushioning component and below the cushioning component;

the shell has pleats with folds of the pleats at a perimeter of the bottom surface of the shell, and with the folds positioned between the support members and extending up side surfaces of an upper portion of the shell.

30. The article of footwear of claim 29, wherein:

the shell has an outer layer, an inner layer and a middle layer between the inner layer and the outer layer; and the outer layer is the textile layer, the inner layer is a second textile layer, and the middle layer is at least partially foam.

31. The article of footwear of claim 29, wherein:

the shell has a ridge that extends toward the opening to at least partially separate the cavity into compartments; and the cushioning component has a first portion configured to fit into a first one of the compartments.

32. The article of footwear of claim 31, wherein:

the ridge is a longitudinally-extending ridge and the shell also has laterally-extending ridges; and the longitudinally-extending ridge is contiguous with at least some of the laterally-extending ridges.

* * * * *